US008025490B2

(12) United States Patent
Lee et al.

(10) Patent No.: US 8,025,490 B2
(45) Date of Patent: Sep. 27, 2011

(54) SERIAL FAN ASSEMBLY AND CONNECTION STRUCTURE THEREOF

(75) Inventors: Kun-Ming Lee, Taoyuan Hsien (TW); Ya-Hui Hung, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 217 days.

(21) Appl. No.: 11/980,462

(22) Filed: Oct. 31, 2007

(65) Prior Publication Data

US 2008/0124232 A1 May 29, 2008

(30) Foreign Application Priority Data

Nov. 23, 2006 (TW) ..... 95143379 A

(51) Int. Cl.
*F04D 29/52* (2006.01)
*F01P 5/04* (2006.01)

(52) U.S. Cl. ..... 417/423.5; 417/244; 415/62; 415/66; 415/199.4; 416/125; 416/175; 416/201 A

(58) Field of Classification Search ..... 417/244, 417/423.5; 416/120, 124, 125, 175, 198 R, 416/201 R, 201 A; 415/60, 62, 64, 66, 68, 415/143, 198.1, 199.4, 199.5, 208.2, 211.2, 415/213.1, 220

See application file for complete search history.

(56) References Cited

U.S. PATENT DOCUMENTS

| | | | | |
|---|---|---|---|---|
| 383,217 | A * | 5/1888 | Fox | 415/144 |
| 2,020,180 | A * | 11/1935 | Havill | 417/84 |
| 2,037,395 | A * | 4/1936 | Seelig | 415/160 |
| 2,313,413 | A * | 3/1943 | Weske | 415/193 |
| 2,339,602 | A * | 1/1944 | Hagen | 416/201 R |
| 2,371,821 | A * | 3/1945 | Havis | 416/207 |
| 2,981,464 | A * | 4/1961 | Omohundro | 415/68 |
| 3,768,546 | A * | 10/1973 | Shipes | 165/96 |
| 4,774,631 | A * | 9/1988 | Okuyama et al. | 361/695 |
| 6,407,918 | B1 * | 6/2002 | Edmunds et al. | 361/695 |
| 6,612,817 | B2 * | 9/2003 | Lin et al. | 417/423.5 |
| 6,752,587 | B2 * | 6/2004 | Lin et al. | 415/66 |
| 6,904,960 | B1 * | 6/2005 | Su et al. | 165/122 |
| 7,120,019 | B2 * | 10/2006 | Foster et al. | 361/695 |
| 2002/0168277 | A1 * | 11/2002 | Hsieh | 417/423.5 |
| 2004/0228722 | A1 * | 11/2004 | Horng et al. | 415/66 |

* cited by examiner

*Primary Examiner* — Devon C Kramer
*Assistant Examiner* — Nathan Zollinger
(74) *Attorney, Agent, or Firm* — Birch, Stewart, Kolasch & Birch, LLP

(57) ABSTRACT

A connection structure is applied to a serial fan assembly, which includes an upstream fan and a downstream fan. The upstream fan and the downstream fan have different sizes. The connection structure connects the upstream fan and the downstream fan so that the upstream fan and the downstream fan are arranged in series. The connection structure has a housing, a base and a plurality of ribs for connecting the base, and the housing is formed with an air guiding passage and a chamber. The upstream fan or the downstream fan is accommodated in the chamber or the air guiding passage is located between the upstream fan and the downstream fan.

17 Claims, 8 Drawing Sheets

SERIAL FAN ASSEMBLY AND CONNECTION STRUCTURE THEREOF

CROSS REFERENCE TO RELATED APPLICATIONS

This Non-provisional application claims priority under 35 U.S.C. §119(a) on Patent Application No(s). 095143379, filed in Taiwan, Republic of China on Nov. 23, 2006, the entire contents of which are hereby incorporated by reference.

BACKGROUND OF THE INVENTION

1. Field of Invention

The present invention relates to a fan and a connection structure thereof. In particular, the present invention relates to a serial fan assembly and a connection structure thereof.

2. Related Art

Electronic products have been rapidly developed toward the properties of high performance, high frequency, high speed, thin thickness and light weight, so the heat generated from the electronic product causes the temperature getting higher and higher during its operation. Thus, high temperature causes unstable phenomenon and further influences the product reliability. Accordingly, the heat dissipation has become one of the important subjects in development of current electronic products.

Among the current electronic products, a fan is often used in heat dissipation. However, for the electronic product that generates lots of heat, only one single fan cannot effectively dissipate the heat energy generated therefrom. In addition, multiple fans are provided not only to enhance the air volume but also to prevent the situation that only single fan is applied and this fan has a fault so as to interrupt total heat dissipation.

FIG. 1 is a schematic illustration showing a conventional fan assembly 1. As shown in FIG. 1, the conventional fan assembly 1 is composed of two fans, such as a first fan 10 and a second fan 11, which are the same and connected in series. When the movable blades 101 and 111 of the fans 10 and 11 rotate, an air flow is generated from the first fan 10 to the second fan 11 and then flows out of the second fan 11. However, because there are typically static blades 102 and 112 respectively disposed at outlets of the first fan 10 and the second fan 11, the flowing direction of the air flow is not perpendicular to a plane of the inlet and is slightly skewed relative to the axial direction of the fan owing to the static blades 102 and 112. So, when the first fan 10 and the second fan 11 are assembled and the air flow outputted from the first fan 10 tends to enter the second fan 11, a portion of the air flow will be offset due to the skewed flowing direction of the air flow so that the speed and the quantity of the air flow outputted from the second fan 11 is reduced. Consequently, when the first fan 10 and the second fan 11 are assembled, the air output efficiency of the first fan 10 and the air output efficiency of the second fan 11 influence each other. Once the arrangement is poor, no synergy effect is obtained or even the negative effect may occur when the fan and another fan are connected in series.

Therefore, it is an important subject to provide a serial fan assembly and a connection structure of the serial fan assembly capable of increasing the air pressure and the air volume of the output air flow effectively and thus enhancing the overall heat dissipating efficiency.

SUMMARY OF THE INVENTION

In view of the foregoing, the present invention is to provide a serial fan assembly and a connection structure thereof capable of increasing an air pressure and an air volume of output air flows, so that the heat dissipating efficiency can be effectively enhanced.

To achieve the above, the present invention discloses a connection structure, which is used in a serial fan assembly. The serial fan assembly includes an upstream fan and a downstream fan, which have different sizes. The connection structure connects the upstream fan and the downstream fan so that the upstream fan and the downstream fan are arranged in series.

To achieve the above, the present invention also discloses a serial fan assembly including an upstream fan, a downstream fan and a connection structure. The upstream fan and the downstream fan have different sizes. The connection structure connects the upstream fan and the downstream fan so that the upstream fan and the downstream fan are arranged in series.

In addition, the present invention further discloses a serial fan assembly including an upstream fan, a middle-stream fan, a first connection structure, a downstream fan and a second connection structure. Each of the upstream fan and downstream fan has a size different from that of the middle-stream fan. The first connection structure connects the upstream fan with the middle-stream fan so that the upstream fan and the middle-stream fan are arranged in series. The second connection structure connects the middle-stream fan and the downstream fan so that the middle-stream fan and the downstream fan are arranged in series.

As mentioned above, multiple fans having different sizes are connected in series through at least one connection structure in the serial fan assembly according to the present invention. When the connection structure connects the upstream fan with the larger size and the downstream fan with the smaller size, the air flow enters the upstream fan, and is then guided to the downstream fan through the connection structure and outputted. Because the air flow is converged and outputted, the air pressure of the output air flow of the serial fan assembly is effectively increased. In addition, when two connection structures connect an upstream fan, a middle-stream fan and a downstream fan together, and the size of the middle-stream fan is smaller than that of each of the upstream fan and the downstream fan, the air flow enters the upstream fan and flows through the middle-stream fan and the downstream fan, and is then outputted from the downstream fan. Because the air flow is compressed by the middle-stream fan and is finally driven by the downstream fan with the larger size, the air pressure of the output air flow is increased, and the air volume is also increased. Thus, the overall heat dissipating efficiency of the serial fan assembly is thus enhanced.

BRIEF DESCRIPTION OF THE DRAWINGS

The present invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
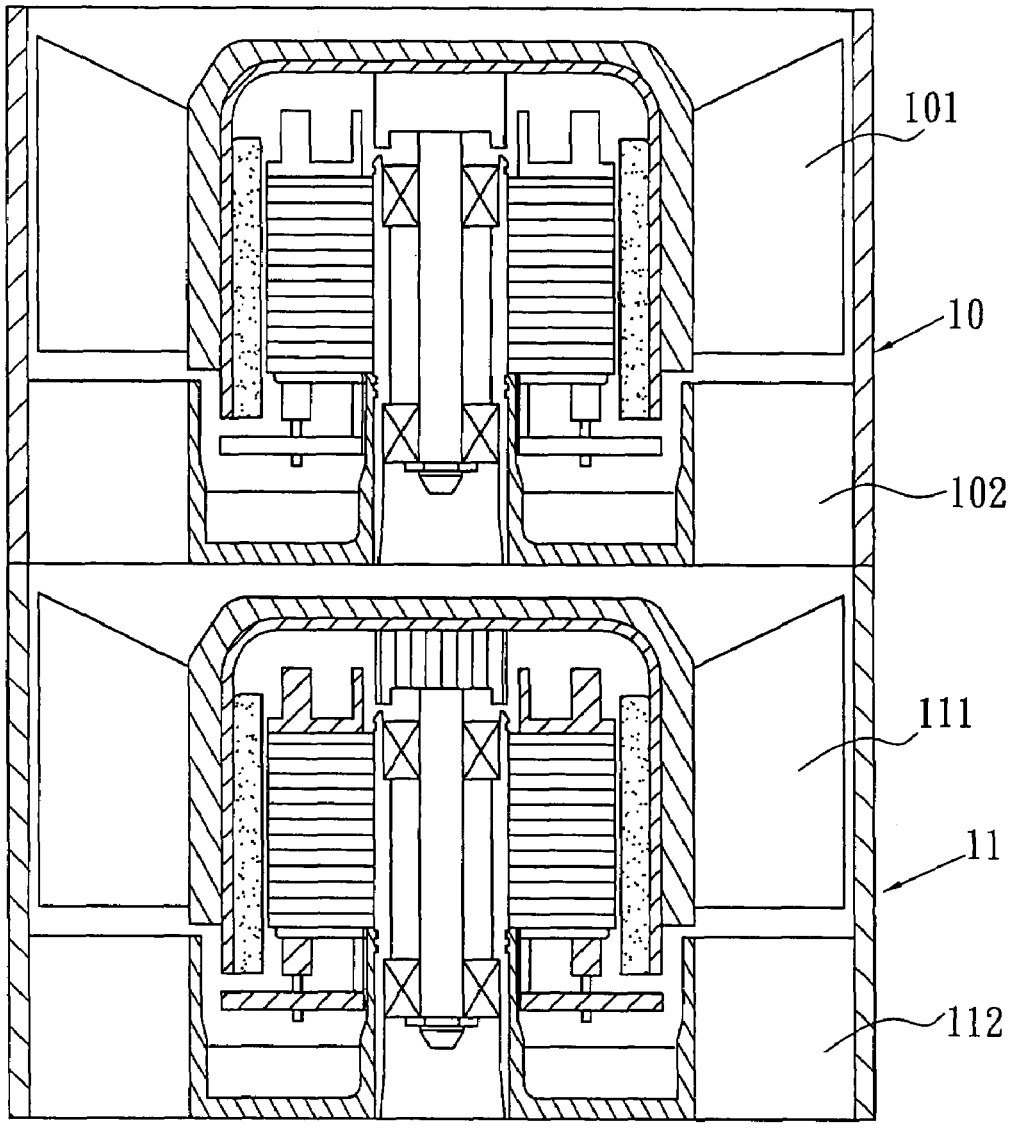
FIG. 1 (PRIOR ART)
FIG. 1 is a schematic illustration showing a conventional fan assembly.
Figure 2:
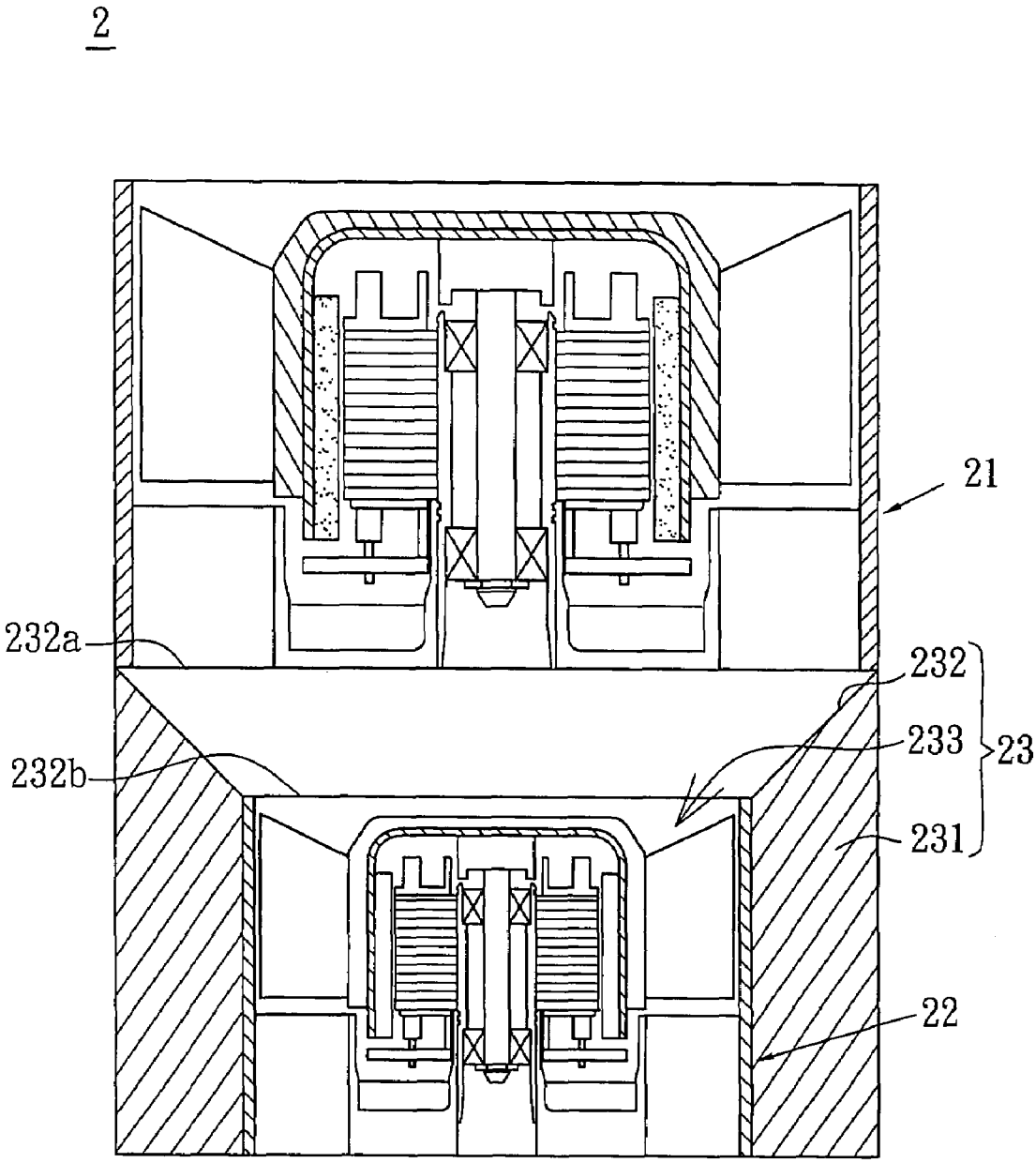
FIGS. 2 and 3 are schematic illustrations showing a serial fan assembly according to the preferred embodiment of the present invention.

Referring to FIG. 2, a serial fan assembly 2 according to the preferred embodiment of the present invention includes an upstream fan 21, a downstream fan 22 and a connection structure 23. The upstream fan 21 and the downstream fan 22 may be axial-flow fans.

The connection structure 23 connects the upstream fan 21 and the downstream fan 22 so that the upstream fan 21 and the downstream fan 22 are arranged in series. In this embodiment, the connection structure 23 and the upstream fan 21 or the downstream fan 22 may be connected with each other by way of engaging, fastening, embedding, adhering, welding, bonding or other ways.

Figure 3:
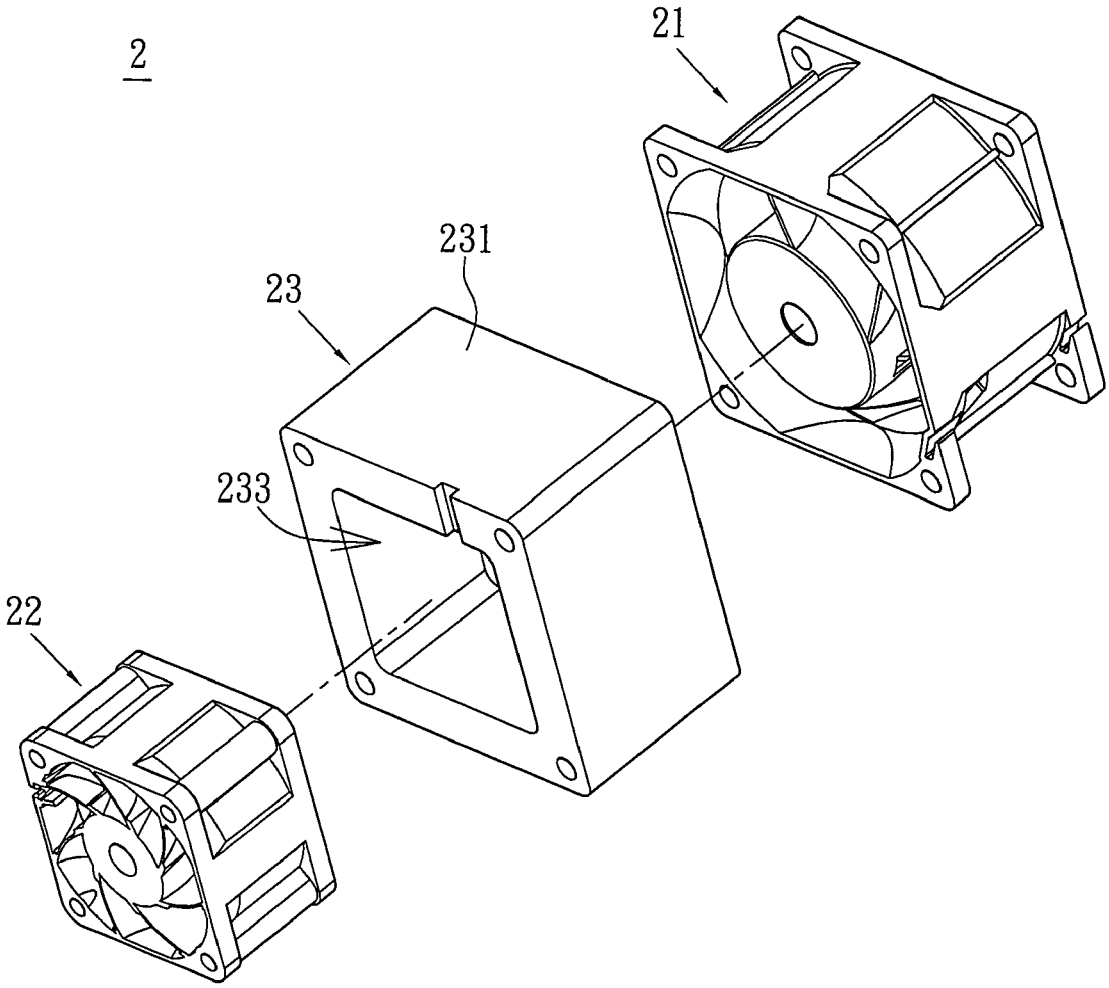

As shown in FIGS. 2 and 3, the upstream fan 21 and the downstream fan 22 have different sizes. In this embodiment, the size of the upstream fan 21 is greater than that of the downstream fan 22. In detail, the fans 21 and 22 operate to generate an air flow, which moves in a direction from the upstream fan 21 to the downstream fan 22. Herein, the connection structure 23 may serve as a flow-guide structure having a housing 231 formed with an air guiding passage 232 and a chamber 233. The downstream fan 22 is tightly accommodated in the chamber 233. The air guiding passage 232 is disposed between the upstream fan 21 and the downstream fan 22, and has a first surface 232*a* connected with an outlet of the upstream fan 21 and a second surface 232*b* connected with an inlet of the downstream fan 22. Thus, when the serial fan assembly 2 operates to generate an air flow, the air flow enters the upstream fan 21 with the larger size, and then the air guiding passage 232 of the connection structure 23 de-skews the skewed air flow at the outlet caused by the movable blades of the upstream fan 21 so that the air flow is guided into the downstream fan 22 with the smaller size in a direction parallel to the axial direction. The downstream fan 22 converges and compresses the air flow and then outputs the converged and compressed air flow so that the overall air pressure can be effectively increased. In addition, although the figures are not shown, the serial fan assembly 2 of this embodiment may also be composed of the upstream fan 21 with the smaller size and the downstream fan 22 with the larger size. That is, the air flow is guided from the fan with the smaller size to the fan with the larger size and is then outputted. Herein, the upstream fan 21 is tightly accommodated in the chamber 233 of the connection structure 23. Thus, the air pressure can be still increased according to the upstream fan 21, which compresses the air flow.

Figure 4:
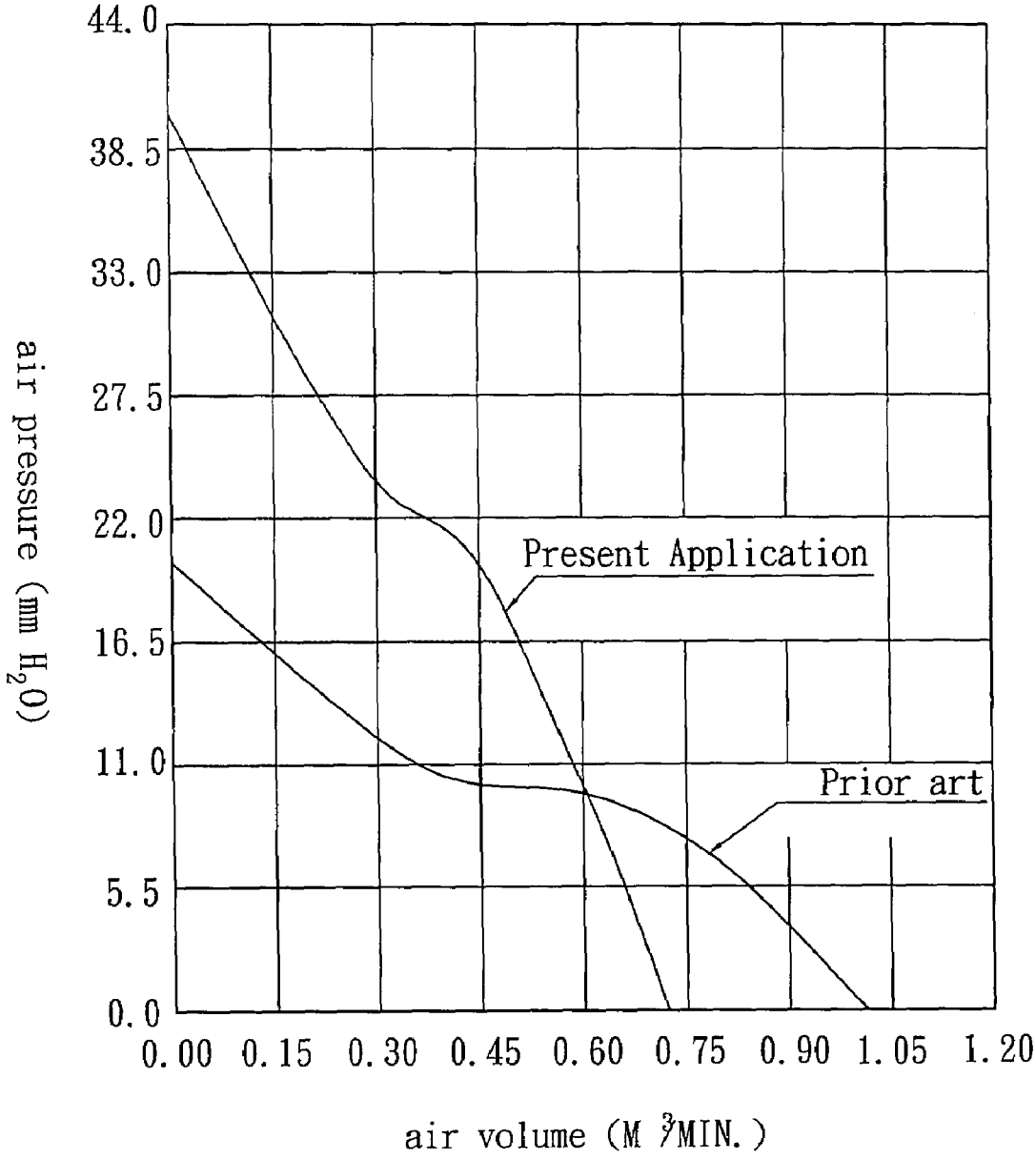
FIG. 4 is a measured and experimental graph showing air pressures versus air volumes relationships for the serial fan assemblies of the present invention and the prior art.

FIG. 4 is a comparison chart showing the air pressures versus the air volumes relationships for the serial fan assembly 2 having fans with different sizes and the serial fan assembly having fans with the same size in a display system. As shown in the drawing, the overall air pressure produced by the serial fan assembly 2 of the present invention is effectively increased as compared with the serial fan assembly of prior art under the condition where the rotating speed is 6000 rpm.

Figure 5A:
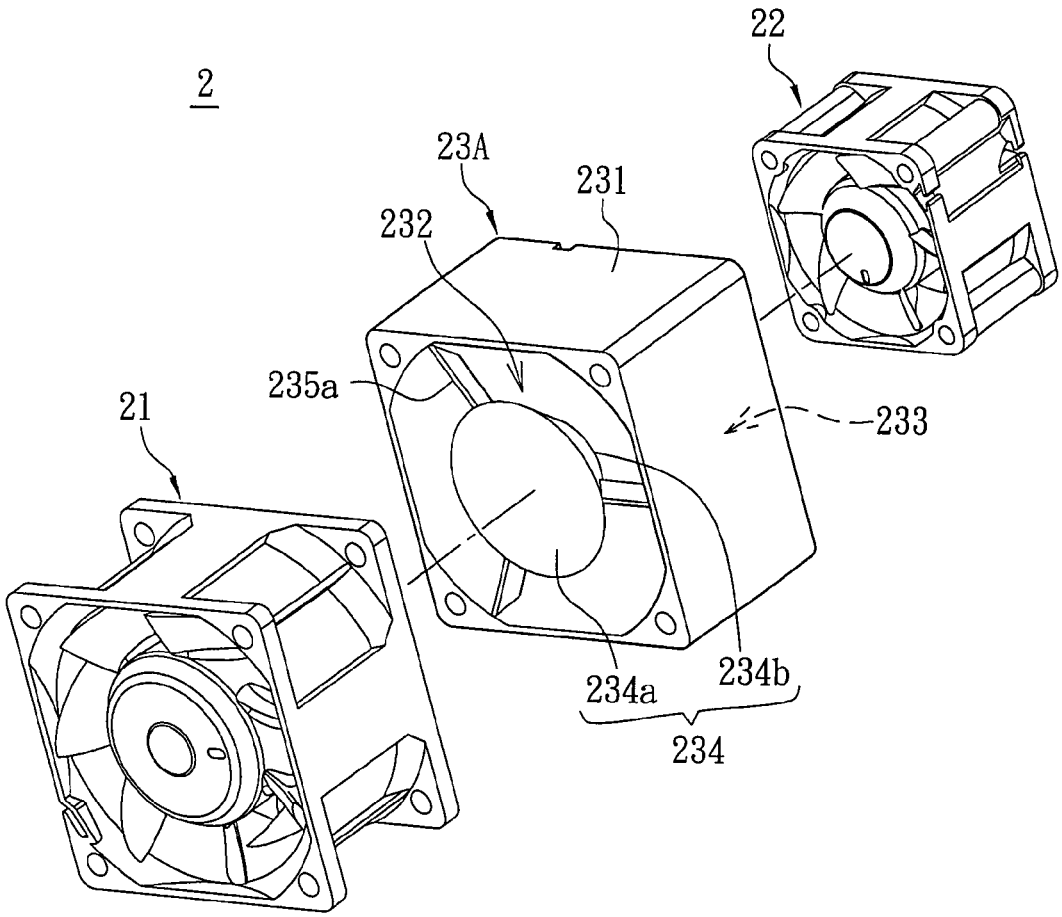
FIGS. 5A and 5B are schematic illustrations showing the connector structures in the serial fan assembly according to the embodiment of the present invention.
Figure 5B:
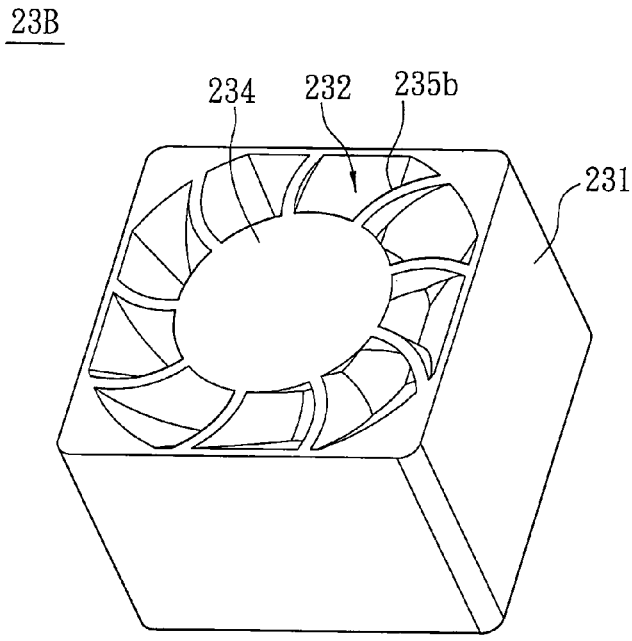
Figure 5C:
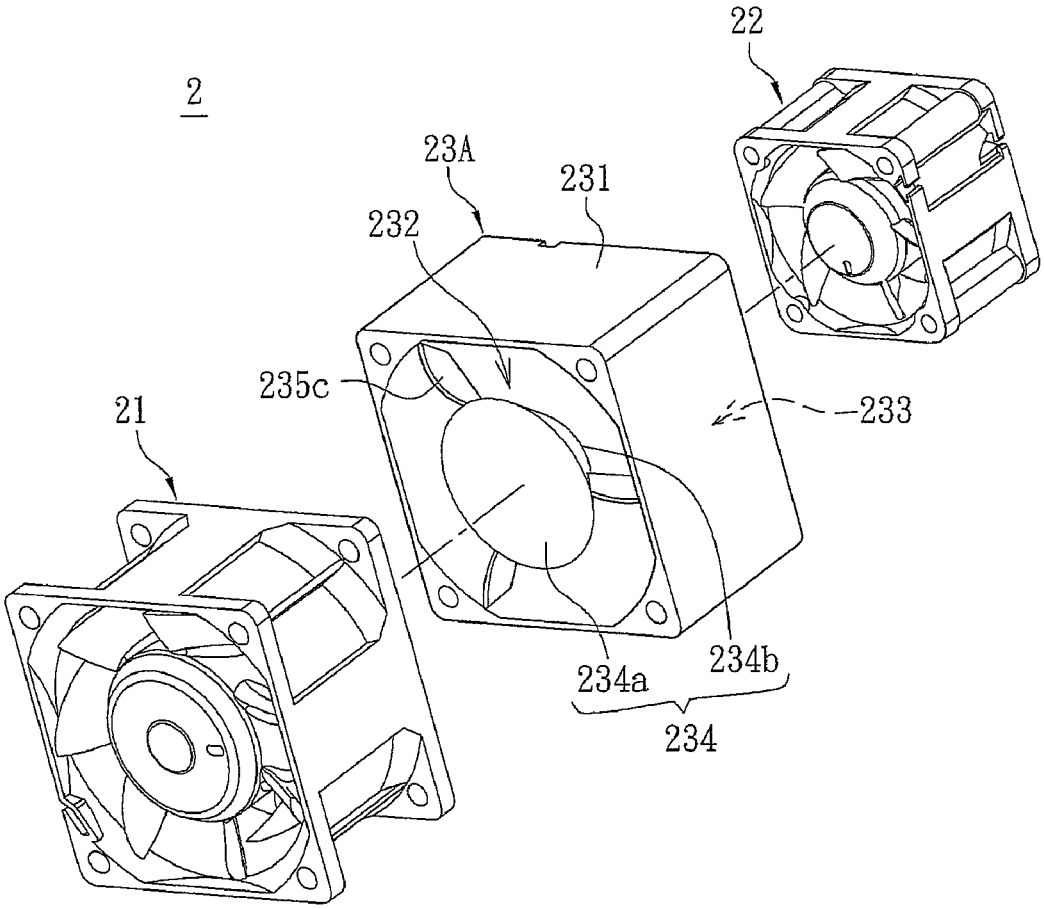

In addition, referring to both FIGS. 5A and 5B, the connection structure 23 may also have the structure constituted by the housing 231, a base 234 and a plurality of ribs 235*a* or 235*b*. The ribs 235*a* or 235*b* connect the base 234 and the housing 231, and the housing 231 is formed with the air guiding passage 232 and the chamber 233. When the connection structure 23 connects the upstream fan 21 with the downstream fan 22, the upstream fan 21 or the downstream fan 22 is accommodated in the chamber 233 according to moving directions of different air flows. In this embodiment, the base 234 extends from one end of the air guiding passage 232 to the other end of the air guiding passage 232. Herein, a first surface 234*a* of the base 234 of the connection structure 23 is connected with a hub of the upstream fan 21, and a second surface 234*b* of the base 234 of the connection structure 23 is connected with a hub of the downstream fan 22. The air guiding passage 232, which is disposed between the upstream fan 21 and the downstream fan 22, de-skews the air flow entering the upstream fan 21, guides the entered air flow to the downstream fan 22 and then outputs the air flow from the downstream fan 22. In addition, the effect of de-skewing the moving direction of the air flow can be enhanced according to the designs of different shapes of the ribs. In FIG. 5A, each rib 235*a* has a flat shape or each rib 235*b* may be a static blade having a wing-like shape (see FIG. 5*b*), and the ribs 235*a* or 235*b* are disposed symmetrically. For example, the geometric distribution thereof may have a radial shape or an irregular geometric shape. In this embodiment, as shown in FIGS. 5A and 5B, the ribs 235*a* or 235*b* and the housing 231 are substantially flush with each other. However, the present invention is not limited thereto. In order to make the flow field at the connection between the upstream fan 21 and the downstream fan 22 become more smoothly, a part of each rib 235C may project beyond the housing 231 and be close to the upstream fan 21 as shown in FIG. 5C.

Figure 6:
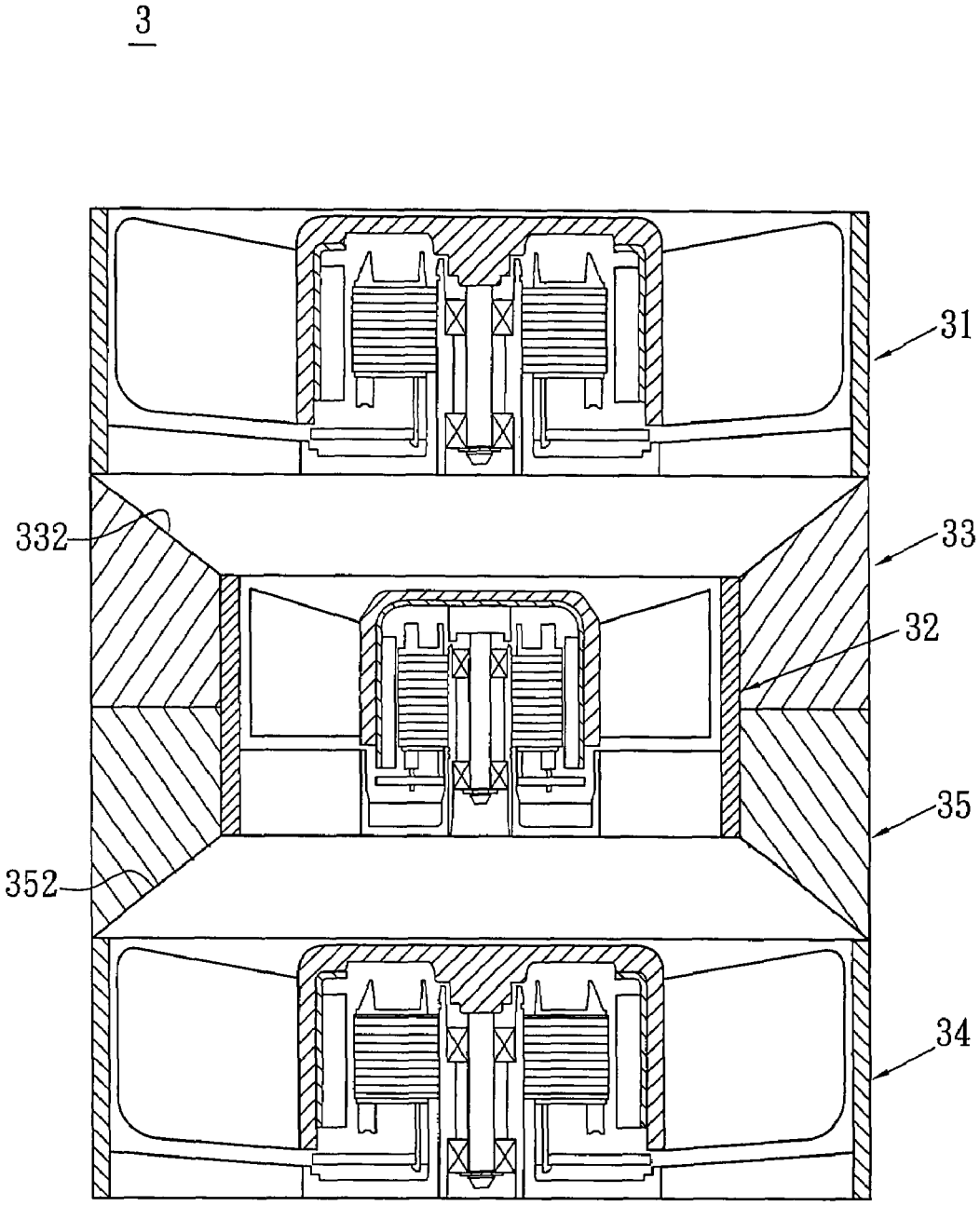
FIG. 6 is a schematic illustration showing another serial fan assembly according to another embodiment of the present invention.

Referring to FIG. 6, a serial fan assembly 3 according to another embodiment of the present invention includes an upstream fan 31, a middle-stream fan 32, a first connection structure 33, a downstream fan 34 and a second connection structure 35. In this embodiment, the upstream fan 31, the middle-stream fan 32 and the downstream fan 34 may be axial-flow fans.

The first connection structure 33 connects the upstream fan 31 and the middle-stream fan 32 so that the upstream fan 31 and the middle-stream fan 32 are arranged in series. The second connection structure 35 connects the middle-stream fan 32 and the downstream fan 34 so that the middle-stream fan 32 and the downstream fan 34 are arranged in series. That is, the upstream fan 31, the middle-stream fan 32 and the downstream fan 34 are sequentially connected in series through the first connection structure 33 and the second connection structure 35.

The structural features of the first connection structure 33 and the second connection structure 35 and the connections between the fans 31, 32 and 34 according to this embodiment are similar to those of the connection structure 23 of the embodiment mentioned hereinabove, so detailed descriptions thereof will be omitted.

In this embodiment, the first connection structure 33 and the second connection structure 35 can be integrally formed as a single piece or can be individual members.

As shown in FIG. 6, the size of the upstream fan 31 is different from the size of the middle-stream fan 32, and the size of the middle-stream fan 32 is also different from the size of the downstream fan 34. In this embodiment, the size of the upstream fan 31 is greater than that of the middle-stream fan 32, and the size of the downstream fan 34 is greater than that of the middle-stream fan 32. The sizes of the upstream fan 31 and the downstream fan 34 may be the same or different from each other. Thus, when the air flow enters the upstream fan 31 and is then outputted from the downstream fan 34, the air flow is sequentially de-skewed by an air guiding passage 332 of the first connection structure 33, compressed by the middle-stream fan 32 and then de-skewed by an air guiding passage 352 of the second connection structure 35. Finally, the air flow flows into the downstream fan 34 and is then outputted. Due to the compressing action of the middle-stream fan 32, the air pressure of the air flow entering the downstream fan 34 is increased. Also, the air volume of the output air flow is increased according to the operating efficiency of the downstream fan 34 having the larger size so that the air pressure and the air volume of the output air flow can be effectively increased.

In summary, multiple fans having different sizes are connected in series through at least one connection structure in the serial fan assembly according to the present invention. When the connection structure connects the upstream fan with the larger size with the downstream fan with the smaller size, the air flow enters the upstream fan, and is then guided to the downstream fan through the connection structure and outputted. Because the air flow is converged and outputted, the air pressure of the output air flow of the serial fan assembly is effectively increased. In addition, when two connection structures connect an upstream fan, a middle-stream fan and a downstream fan together, and the size of the middle-stream fan is smaller than that of each of the upstream fan and the downstream fan, the air flow enters the upstream fan and flows through the middle-stream fan and the downstream fan, and is then outputted from the downstream fan. Because the air flow is compressed by the middle-stream fan and finally driven by the downstream fan with the larger size, the air pressure of the output air flow is increased, and the air volume is also increased. Thus, the overall heat dissipating efficiency of the serial fan assembly is thus enhanced.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A connection frame, used in a serial fan assembly comprising an upstream fan and a downstream fan, wherein the cross-section of an outlet of the upstream fan and the cross-section of an inlet of the downstream fan have different sizes and the connection frame comprises a single housing formed with an air guiding passage and a chamber, the air guiding passage having a first surface and a second surface, wherein a first frame of the upstream fan or a second frame of the downstream fan is accommodated in the chamber, the first surface is connected with the outlet of the upstream fan, and the second surface is connected with the inlet of the downstream fan so that the upstream fan and the downstream fan are arranged in series, wherein the first surface and the second surface have different sizes; and, wherein the connection frame further comprises a base and a plurality of ribs for connecting the base and the single housing, and the base and the ribs are accommodated in the air guiding passage.

2. The connection frame according to claim 1, wherein the air guiding passage is located between the upstream fan and the downstream fan.

3. The connection frame according to claim 1, wherein the upstream fan or the downstream fan is accommodated in the chamber, or the air guiding passage is located between the upstream fan and the downstream fan.

4. The connection frame according to claim 1, wherein the base extends from one end of the air guiding passage to the other end of the air guiding passage.

5. The connection frame according to claim 1, wherein the ribs are substantially flush with the single housing.

6. The connection frame according to claim 1, wherein a part of the ribs projects beyond the single housing and is close to the upstream fan.

7. A serial fan assembly, comprising:

an upstream fan having a first frame;

a downstream fan having a second frame; and a connection frame comprising a single housing formed with an air guiding passage and a chamber, the air guiding passage having a first surface and a second surface, wherein the first frame of the upstream fan or the second frame of the downstream fan is accommodated in the chamber, the first surface is connected with the outlet of the upstream fan, and the second surface is connected with the inlet of the downstream fan so that the upstream fan and the downstream fan are arranged in series, wherein the cross-section of an outlet of the upstream fan and the cross-section of an inlet of the downstream fan have different sizes, and the first surface and the second surface have different sizes; and, wherein the connection frame further comprises a base and a plurality of ribs for connecting the base and the single housing, and the base and the ribs are accommodated in the air guiding passage.

8. The serial fan assembly according to claim 7, wherein the size of the outlet of the upstream fan is greater than or smaller than the size of the inlet of the downstream fan.

9. The serial fan assembly according to claim 7, wherein the air guiding passage is located between the upstream fan and the downstream fan.

10. The serial fan assembly according to claim 7, wherein the upstream fan or the downstream fan is accommodated in the chamber.

11. The serial fan assembly according to claim 7, wherein the air guiding passage is disposed between the upstream fan and the downstream fan.

12. The serial fan assembly according to claim 7, wherein the base extends from one end of the air guiding passage to the other end of the air guiding passage.

13. The serial fan assembly according to claim 7, wherein the ribs are disposed symmetrically, and each of the ribs has a flat shape or a wing-like shape.

14. The serial fan assembly according to claim 7, wherein the ribs are substantially flush with the single housing.

15. The serial fan assembly according to claim 7, wherein a part of each rib projects beyond the single housing and is close to the upstream fan.

16. The serial fan assembly according to claim 7, wherein the connection frame is connected with the upstream fan or the downstream fan by way of engaging, fastening, embedding, adhering, welding or bonding.

17. A serial fan assembly, comprising:

a first fan, having a first frame and a plurality of first blades surrounded by the first frame;

a second fan, having a second frame and a plurality of second blades surrounded by the second frame; and a connection frame, comprising a single housing formed with a chamber and an air guiding passage having a first surface and a second surface, wherein the first frame is mounted on an outer surface of the single housing, the second frame is accommodated in the chamber, the first surface is connected with the outlet of the first fan, and the second surface is connected with the inlet of the second fan so that the first fan and the second fan are arranged in series, wherein the cross-section of an outlet of the first fan and the cross-section of an inlet of the second fan have different sizes, and the first surface and the second surface have different sizes; and, wherein the connection frame further comprises a base and a plurality of ribs for connecting the base and the single housing, and the base and the ribs are accommodated in the air guiding passage.

* * * * *